US006623629B2

(12) United States Patent
Didillon et al.

(10) Patent No.: US 6,623,629 B2
(45) Date of Patent: Sep. 23, 2003

(54) PROCESS FOR ELIMINATING ARSENIC IN THE PRESENCE OF AN ABSORPTION MASS COMPRISING PARTIALLY PRE-SULFURIZED LEAD OXIDE

(75) Inventors: Blaise Didillon, Francheville (FR); Laurent Savary, Rueil-Malmaison (FR)

(73) Assignee: Institut Francais du Petrole, Cedex (FR)

( * ) Notice: Subject to any disclaimer, the term of this patent is extended or adjusted under 35 U.S.C. 154(b) by 0 days.

(21) Appl. No.: 09/800,511

(22) Filed: Mar. 8, 2001

(65) Prior Publication Data

US 2001/0027939 A1 Oct. 11, 2001

(30) Foreign Application Priority Data

Mar. 8, 2000 (FR) ..... 00 03065

(51) Int. Cl.[7] ..... C10G 25/00

(52) U.S. Cl. ..... 208/251 R; 208/253; 208/295; 208/299; 585/820; 585/823

(58) Field of Search ..... 208/251 R, 253, 208/295, 299, 303; 585/820, 823

(56) References Cited

U.S. PATENT DOCUMENTS

| | | | | |
|---|---|---|---|---|
| 3,782,076 A | | 1/1974 | Carr et al. | 55/74 |
| 3,789,581 A | * | 2/1974 | Carr et al. | 95/133 |
| 4,849,577 A | | 7/1989 | Boitiaux et al. | 585/820 |
| 6,007,706 A | * | 12/1999 | Carnell et al. | 208/303 |
| 6,221,241 B1 | * | 4/2001 | Carnell et al. | 208/208 R |

* cited by examiner

*Primary Examiner*—Walter D. Griffin
(74) *Attorney, Agent, or Firm*—Millen, White, Zelano, Branigan, P.C.

(57) ABSTRACT

The invention concerns a process for eliminating arsenic from a hydrocarbon cut in which said cut is brought into contact with an absorption mass that is at least partially pre-sulfurized and comprises a support and lead oxide. The support, for example alumina, or said mass preferably has a specific surface area in the range 10 to 300 $m^2/g$, a total pore volume in the range 0.2 to 1.2 $cm^3/g$ and a macroporous volume in the range 0.1 to 0.5 $cm^3/g$. The lead content of said mass, expressed as lead oxide, is preferably in the range of 5% to 50% by weight. The fraction of the sulfurized mass preferably represents at least 1/20th of the total volume of the absorption mass.

22 Claims, 1 Drawing Sheet

Figure 1:
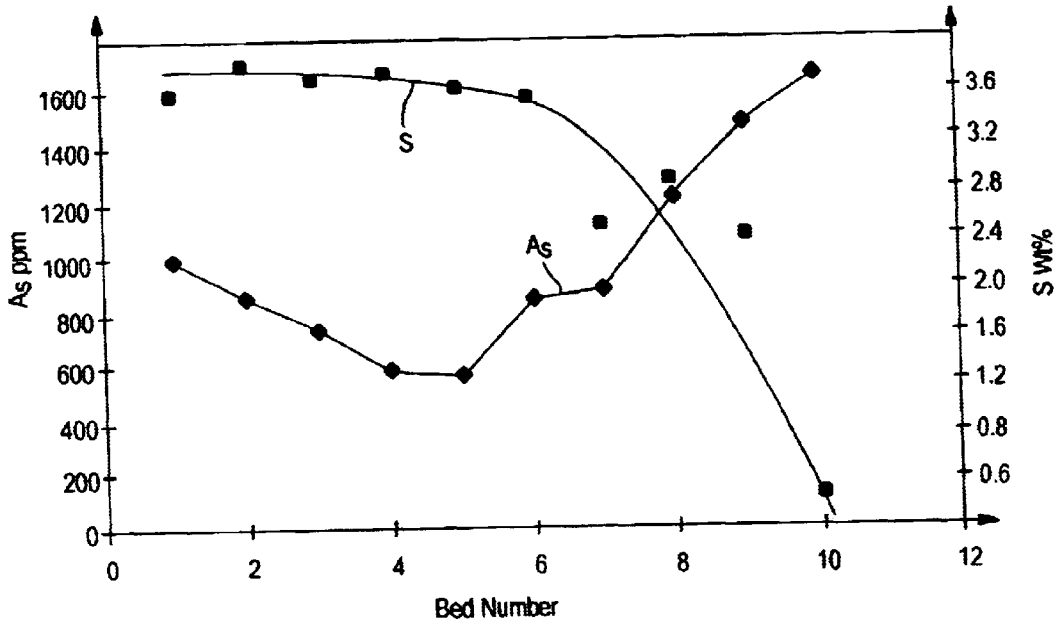

PROCESS FOR ELIMINATING ARSENIC IN THE PRESENCE OF AN ABSORPTION MASS COMPRISING PARTIALLY PRE-SULFURIZED LEAD OXIDE

The subject matter of this invention concerns a process for capturing arsenic using a mass of lead deposited on alumina, wherein the active phase is in the oxide form regarding a portion of the catalytic bed, preferably the major portion of the catalytic bed, and in the pre-sulphurised form regarding the other portion. Mercaptans are known to be powerful arsenic capture inhibitors. However, it has been observed that pre-sulphurising a portion of the catalytic bed can result in a very good arsenic capture gradient over the remainder of the bed even when mercaptans are present in the feed, in contrast to that observed in the absence of a pre-sulphurisation step.

PRIOR ART

Processes for cracking heavy petroleum cuts, for example catalytic cracking, visbreaking or cokefaction, produce light cuts that are strongly contaminated with various compounds containing sulphur, nitrogen and oxygen. Arsenic is often detected alongside those impurities.

The sulphur-containing compounds are usually hydrogen sulfide and mercaptans. The nitrogen-containing compounds, present in the light cuts, are principally ammonia or light amines. Arsenic is itself also present in the form of compounds with the general formula $AsR_3$, R being a hydrocarbon radical such as $CH_3$ or a hydrogen atom.

The term "light cuts" as used here means those that are gaseous under normal pressure and temperature conditions, i.e., $C_2$, $C_3$ or $C_4$ cuts. Such cuts are generally treated to eliminate sulphur-containing compounds. In particular, $C_3$ and $C_4$ cuts usually undergo an amine washing treatment, followed by washing with sodium hydroxide. Those different washes eliminate almost all of the $H_2S$, only a portion of organic sulphur-containing compounds such as mercaptans, and only extract COS in a very incomplete fashion.

In general, $C_3$ and $C_4$ cuts, which contains a large proportion of olefins, constitute a high value starting material for the production of fuels or chemical products such as certain polymers. These transformations involve a variety of catalytic treatments in which the catalysts are poisoned at varying rates by sulphur-containing or arsenic-containing compounds.

Recently, a process for capturing the arsenic contained in hydrocarbons in the gas phase (U.S. Pat. No. 3,782,076) or in the liquid phase (U.S. Pat. No. 4,849,577) have been described, carried out at relatively high pressures (more than 2 MPa) in the presence of sulphur-containing compounds. That process uses an absorbent mass comprising lead oxide and a "non acidic" support, i.e., it does not catalyse reactions known to the skilled person to be catalysed by acidic solids, namely hydrocarbon skeletal isomerisation, cracking and polymerisation.

Following the washing treatments cited above, the $C_3$ cut from fluidised bed catalytic cracking (FCC) still contains COS and/or mercaptans in amounts of the order of 1 to 50 ppm by weight, and arsenic in amounts of the order of 0.1 to 5 ppm by weight.

Thus, providing an arsenic capture mass that can decontaminate a feed even when said feed contains compounds such as mercaptans which may contaminate that mass, would be desirable.

This capture mass is employed in any method that can bring the fluid to be decontaminated into contact with the lead mass.

SUMMARY OF THE INVENTION

The invention concerns a process for eliminating arsenic from a hydrocarbon cut, in which said cut is brought into contact with an absorption mass that is at least partially pre-sulphurised and comprises a support and lead oxide.

The support for said mass preferably has a specific surface area in the range 10 to 300 $m^2/g$, a total pore volume in the range 0.2 to 1.2 $cm^3/g$ and a macroporous volume in the range 0.1 to 0.5 $cm^3/g$. The lead content of said mass, expressed as lead oxide, is preferably in the range 5% to 50% by weight. The fraction of the sulphurised mass preferably represents at least $1/20^{th}$ of the total volume of the absorption mass.

DETAILED DESCRIPTION OF THE INVENTION

The present invention concerns a process for eliminating arsenic from a hydrocarbon cut in which said cut is brought into contact with an absorption mass that is at least partially pre-sulphurised and comprises a support and lead oxide.

The support used in the present invention can be any support that is known to the skilled person. As an example, and preferably, alumina, silica or magnesia is used, more preferably alumina, which can produce both relatively large specific surface areas and sufficient mechanical strength.

The recommended support for the invention is an alumina with a surface area in the range 10 to 300 $m^2/g$, preferably in the range 50 to 200 $m^2/g$. Its total pore volume is preferably in the range 0.2 to 1.2 $cm^3/g$, more preferably in the range 0.5 to 1.2 $cm^3/g$. The macroporous volume, defined as that corresponding to pores over 100 nm, is preferably in the range 0.1 to 0.5 $cm^3/g$, more preferably in the range 0.15 to 0.45 $cm^3/g$.

The absorbent mass containing lead oxide can be prepared using any technique that is known to the skilled person. It is prepared by mixing a lead compound with the support, using known techniques. One preparation procedure that routinely leads to a high performance mass is "dry" impregnation, i.e., filling the pores of the support with an aqueous solution of a lead salt by a volume equal to the pore volume of the support. Any sufficiently soluble lead salt can be used, such as lead nitrate or lead acetate. Preferably, lead acetate is used, as it has a satisfactory solubility and can produce a capture mass with a high efficiency.

After impregnating the support with the solution of the lead compound, the mass is heated to a temperature in the range 300° C. to 700° C., preferably in the range 400° C. to 550° C., to convert the lead compound into lead oxide. Preferably, an atmosphere containing oxygen is employed.

The masses obtained advantageously comprise 5% to 50% by weight of lead, preferably 10% to 45% by weight, more preferably 15% to 40% by weight of lead, these percentages being expressed as lead oxide.

Absorption is carried out at a temperature that is preferably in the range 5° C. to 150° C., ore preferably in the range 10° C. to 100° C., at a pressure that can maintain the cut to be treated either in the gas phase or in the liquid phase, for example, in the range 0.1 MPa to 4 MPa, preferably in the range 0.5 MPa to 2.5 MPa. The absorbent mass is thus in different chemical forms: an oxide form and a pre-sulphurised form.

When the amount of sulphur-containing contaminants (COS, $H_2S$, mercaptans) is low, a capture mass is preferably used in the process of the invention that preferably comprises only a very small proportion of pre-sulphurised mass, for example $1/20^{th}$ to $1/10^{th}$ of the total volume of the absorption bed or beds, more preferably $1/20^{th}$ to $1/15^{th}$ of the total volume of the absorption bed or beds.

When the feed to be treated has a higher sulphur-containing contaminant content, more particularly mercaptans, then preferably the capture mass used is in an at least partially pre-sulphurised form, preferably in a proportion of at least $1/15^{th}$ of the total volume of the catalytic bed, more preferably at least $1/10^{th}$ and very preferably at least $1/5^{th}$.

It has been shown that the absorbent mass has a poor arsine capture gradient when the feed to be decontaminated has a non negligible mercaptan content. Mercaptans usually cause severe inhibition of arsenic capture.

In contrast, pre-sulphurising the capture mass can produce a very good capture gradient in the remainder of the catalytic bed, which remains in the form of lead oxide PbO, deposited on the support.

This first layer of pre-sulphurized absorbent can decompose mercaptans into sulphur-containing compounds that are not poisons and do not impair arsenic capture over the remainder of the catalytic bed, which remains in the oxide form.

Pre-sulphurisation of the capture mass is preferably carried out with any sulphur-containing compound with the exception of mercaptans. Examples that can be cited are COS or hydrogen sulphide, alone or as a mixture with an inert gas or hydrogen.

This pre-sulphurisation can be carried out in situ, i.e., in the absorption reactor, or ex situ, i.e., outside the absorption reactor and preferably offsite, i.e., generally by an enterprise accustomed to offsite catalyst sulphurisation.

When the treatment is carried out in situ, the fraction of catalytic bed to be pre-sulphurised is preferably isolated, for example by optionally disposing the absorption mass in a plurality of successive beds inside the same reactor, or by placing the fraction of the absorption mass to be pre-sulphurised in a separate reactor, preferably located upstream of the other reactor or reactors.

Preferably, the sulphurised fraction and the oxide fraction of said mass are distributed in at least two reactors disposed in series. More preferably, the sulphurised fraction of said mass is disposed in a separate reactor located upstream of at least one other reactor containing the fraction of said mass in its oxide form. However, it is possible to place the pre-sulphurised fraction and the oxide fraction of said mass in a single reactor.

The following examples illustrate the present invention.

EXAMPLE 1

Preparation of Lead Oxide Mass:

The arsenic absorption mass was prepared by dry impregnation of an aqueous solution containing lead acetate followed by drying for 3 hours at 100° C. and calcining for 5 hours at 500° C.

Pre-Sulphurisation of Lead Mass:

10 g of lead mass was treated in a $H_2S/H_2$ mixture at 100° C. for 7 hours at a flow rate of 4 l/h. Cooling was carried out in $H_2S/H_2$ to 50° C., at which temperature the circuit was purged with Ar. Analysis using an X ray diffraction (XRD) apparatus showed the presence of crystalline PbS. The mean crystallite size was 4 nanometers (nm), the size of some particles being 10 to 20 nm.

The sulphur content in the mass was 3.8% by weight, corresponding to a Pb/S stoichiometry of close to 1, signifying complete sulphurisation of the samples.

EXAMPLE 2

Capture Test

The capture test (arsenic absorption) was carried out under the following operating conditions: 200 ppm of arsenic in the form of $AsH_3$ was introduced into a $H_2/CH_3SH$ mixture which supplied the test zone at a flow rate of 1.6 liters per hour at ambient temperature.

The pre-sulphurised mass was placed at the head of the reactor (bed 1 and 2); the next 8 beds were constituted by a non-sulphurised mass. The following table shows the test results:

| | As, % | S, % |
|---|---|---|
| Bed 1 | 0.135 | 3.66 |
| Bed 2 | 0.13 | 3.76 |
| Bed 3 | 1.72 | 2.12 |
| Bed 4 | 1.15 | 1.84 |
| Bed 5 | 0.63 | 2 |
| Bed 6 | 0.31 | 1.9 |
| Bed 7 | 0.15 | 2.2 |
| Bed 8 | 0.074 | 2.21 |
| Bed 9 | 0.02 | 1.59 |
| Bed 10 | <50 ppm | 0.127 |

Thus arsenic capture in the presence of mercaptans was satisfactory for the non-pre-sulphurised portion of the catalytic bed.

EXAMPLE 3

Comparison of Arsenic Capture Performances Between a Non Pre-Sulphurised Mass and a Pre-Sulphurised Mass in the First Two Beds The tests were carried out under operating conditions that were identical to those of Example 1.

A first test was carried out with 10 identical beds each comprising 10 g of lead oxide absorption mass (FIG. 1).

Figure 2:
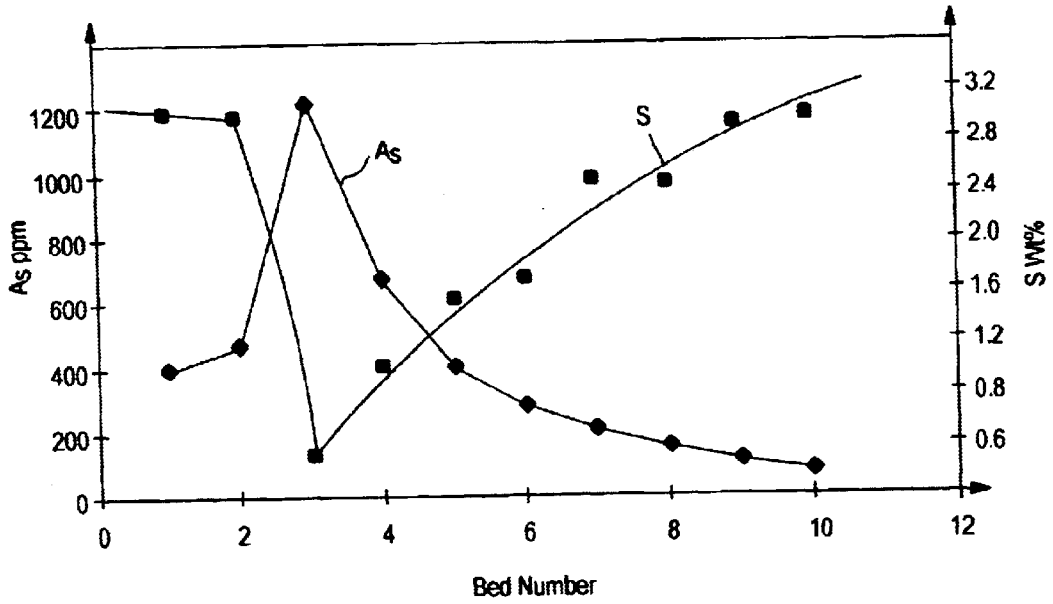

A second test was carried out with the first two beds being pre-sulphurised lead mass, then 8 beds of lead oxide mass (FIG. 2).

The results shown in FIGS. 1 and 2 demonstrate the good performances of the pre-sulphurised mass on the first two beds compared with the non pre-sulphurised mass. In the figures, the squares represent the sulphur content (weight %) in each bed of absorption mass and the diamonds represent the arsenic captured in each bed (ppm by weight of arsenic). The non presulphurised mass captured arsenic from the outlet from the second bed in a significant manner (FIG. 2), meaning that there was no longer a large amount of arsenic to be absorbed over the last beds (8, 9 and 10). In contrast, in the test carried out with an entirely oxidized mass (FIG. 1), a large amount of arsenic was captured on the last beds, and thus some of the arsenic was not captured.

What is claimed is:

1. A process for eliminating arsenic from a hydrocarbon cut containing mercaptans and arsenic, in which said cut is brought into contact with an absorption mass which comprises a support and lead oxide, said process comprising:

contacting said cut with a presulfurized fraction of said absorption mass whereby mercaptans are decomposed, and subsequently, contacting said cut with a non-presulfurized oxide fraction of said absorption mass whereby arsenic is removed.

2. A process according to claim 1, in which said presulfurized fraction of said absorption mass is pre-sulphurised outside of an absorption reactor.

3. A process according to claim 1, in which said presulfurized fraction of said absorption mass is pre-sulphurised within an absorption reactor.

4. A process according to claim 1, in which the pre-sulphurised fraction of said absorption mass and the oxide fraction of said absorption mass are distributed in at least two reactors disposed in series.

5. A process according to claim 4, in which the pre-sulphurised fraction of said absorption mass is disposed in a separate reactor located upstream of at least one other reactor containing the oxide fraction of said absorption mass.

6. A process according to claim 1, in which the pre-sulphurised fraction of said absorption mass and the oxide fraction of said absorption mass are disposed in a single reactor.

7. A process according to claim 1, in which the support has a specific surface area in the range of 10 to 300 $m^2/g$, a total pore volume in the range of 0.2 to 1.2 $cm^3/g$ and a macroporous volume in the range of 0.1 to 0.5 $cm^3/g$.

8. A process according to claim 1, in which the lead content of the absorption mass, expressed as lead oxide, is in the range of 5% to 50% by weight.

9. A process according to claim 1, in which absorption is carried out at a temperature in the range of 5° C. to 150° C. and at a pressure in the range of 0.1 MPa to 4 MPa.

10. A process according to claim 1, in which the pre-sulphurised fraction of the absorption mass represents at least $1/20^{th}$ of the total volume of the absorption mass.

11. A process according to claim 1, in which the pre-sulphurised fraction of said absorption mass and the oxide fraction of said absorption mass are distributed in at least two reactors disposed in series, the support has a specific surface are in the range of 10 to 300 $m^2/g$, a total pore volume in the range of 0.2 to 1.2 $cm^2/g$, and a macroporous volume in the range of 0.1 to 0.5 $cm^2/g$, the lead content of the absorption mass, expressed as lead oxide, is in the range of 5% to 50% by weight, and the pre-sulphurised fraction of the absorption mass represents at least 1/20th of the total volume of the absorption mass.

12. A process according to claim 1, in which the pre-sulphurised fraction of said absorption mass is disposed in a separate reactor located upstream of at least one other reactor containing the oxide fraction of said mass, the support has a specific surface area in the range of 10 too 300 $m^2/g$, a total pore volume in the range of 0.2 to 1.2 $cm^2/g$, and a macroporous volume in the range of 0.1 to 0.5 $cm^2/g$, the lead content of the absorption mass, expressed as lead oxide, is in the range of 5–50% by weight, and the pre-sulphurised fraction of the absorption mass represents at least 1/20th of the total volume of the absorption mass.

13. A process according to claim 1, wherein said support is alumina, silica or magnesia.

14. A process according to claim 7, wherein said support is alumina and has a surface area in the range of 50 to 200 $m^2/g$.

15. A process according to claim 7, in which said support is alumina and has a total pore volume in the range of 0.5 to 1.2 $cm^2/g$.

16. A process according to claim 7, wherein said support is alumina and has a macroporous volume in the range of 0.15 to 0.45 $cm^2/g$.

17. A process according to claim 8, in which the lead content of the absorption mass, expressed as lead oxide, is 10 to 45% by weight.

18. A process according to claim 8, in which the lead content of the absorption mass, expressed as lead oxide, is 15 to 40% by weight.

19. A process according to claim 9, in which absorption is carried out at a temperature in the range of 10 to 100° C.

20. A process according to claim 9, in which absorption is carried out at a pressure of 0.5 MPa to 2.5 MPa.

21. A process according to claim 10, where the pre-sulphurised fraction of the absorption mass is 1/20th to 1/10th of the total volume of the absorption mass.

22. A process according to claim 1, in which the pre-sulphurised fraction of the absorption mass represents at least $1/15^{th}$ of the total volume of the absorption mass.

* * * * *